US006220486B1

(12) United States Patent
Teramachi et al.

(10) Patent No.: US 6,220,486 B1
(45) **Date of Patent: *Apr. 24, 2001**

(54) POWDER PAINT FEEDER FOR POWDER COATING

(75) Inventors: Youjirou Teramachi; Hiroshi Murata; Tadashi Fuyuki; Eiji Shinoda; Yukio Iwata, all of Saitama (JP)

(73) Assignee: Nisshin Flour Milling Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/346,049

(22) Filed: Jul. 7, 1999

(51) Int. Cl.[7] ..... B05B 5/00

(52) U.S. Cl. ..... 222/195; 222/226; 222/240; 222/412

(58) Field of Search ..... 222/195, 226, 222/227, 236, 239–242, 412, 413

(56) References Cited

U.S. PATENT DOCUMENTS

| | | | | |
|---|---|---|---|---|
| 3,920,153 | * | 11/1975 | Saito | 222/14 |
| 4,579,482 | * | 4/1986 | Gastaldi et al. | 406/33 |
| 4,632,284 | * | 12/1986 | Erazo et al. | 222/615 |
| 4,726,715 | * | 2/1988 | Steen et al. | 406/55 |
| 4,770,344 | * | 9/1988 | Kaiser | 239/8 |
| 5,052,874 | * | 10/1991 | Johanson | 414/326 |
| 5,154,326 | * | 10/1992 | Chang et al. | 222/196 |
| 5,240,185 | * | 8/1993 | Kaiju et al. | 239/690 |
| 5,538,053 | * | 7/1996 | Derby | 141/71 |
| 5,662,272 | * | 9/1997 | Buquet et al. | 239/325 |
| 5,768,800 | | 6/1998 | Merritt et al. | 34/576 |
| 5,836,722 | * | 11/1998 | Lacchia | 406/122 |
| 5,947,342 | * | 9/1999 | Song | 222/413 |
| 5,964,551 | * | 10/1999 | Wallace | 406/32 |
| 6,010,037 | * | 1/2000 | Thompson | 222/240 |

* cited by examiner

*Primary Examiner*—J. Casimer Jacyna
(74) *Attorney, Agent, or Firm*—Young & Thompson

(57) ABSTRACT

The powder paint feeder for powder coating directly is installed to a powder paint tank of a fluidized bed type. In the powder paint feeder, a cylindrical screw casing is inserted into the powder paint tank and fixed thereto and has an introducing port into which the powder paint fluidized in the powder paint tank is introduced and a discharging port through which the powder paint dispersed externally of the powder paint tank is discharged. A screw is accommodated in the screw casing and feeds the powder paint introduced from the introducing port to the discharging port while compacting it. A deaerating device is disposed to the screw casing and deaerates the fluidized powder paint to accelerate the compaction of the powder paint. A dispersing blade is mounted on the rotational shaft of the screw in the vicinity of the discharging port downstream of the screw for dispersing the compacted powder paint. A driving device rotates the rotational shaft of the screw. The powder paint feeder for powder coating is less expensive and arranged such that it can feed the powder paint with an excellent constant quantity feeding property without being affected by the powder level in a tank and can be washed easily and efficiently.

13 Claims, 5 Drawing Sheets

POWDER PAINT FEEDER FOR POWDER COATING

BACKGROUND OF THE INVENTION

The present invention pertains to a powder paint feeder for powder coating. More particularly, the present invention relates to a powder paint feeder for powder coating which is directly installed to a fluidized bed type powder paint tank and discharges a powder paint in a constant quantity at a pinpoint accuracy.

Powder coating for coating a powder paint without using organic solvent has been widely employed from the view point of the protection of the terrestrial environment. In case of the powder coating and, in particular, in case of electrostatic powder coating, a powder paint stored in a paint tank is sprayed onto an object by a coating gun through a powder paint feeder. Fluidized bed type powder paint tanks (hereinafter, referred to as fluidizing tanks) for applying fluidity to a powder paint by supplying air from under the powder paint have been widely used as the paint tank.

Japanese Unexamined Patent Publication No. 8-57365 discloses, as a powder paint feeder used for a fluidizing tank, an apparatus for directly taking out a powder paint, which has been fluidized in a paint tank by agitating blades, by an ejector and feeding the powder paint into a coating gun. However, the apparatus has a problem that the quantity of feed of the powder paint is changed depending upon the height of the powder level (hereinafter, referred to as the powder level) of the powder paint in the fluidizing tank because the powder paint is taken out as it is from the tank as a fluidized bed through the ejector. That is, the fall of the powder level in the paint tank reduces a powder pressure, whereby a powder volume density is also reduced. As a result, the quantity of the powder paint discharged through the ejector is also reduced. On the other hand, when a powder paint is fed into the paint tank and the powder level of the powder paint rises, the powder volume density is increased and accordingly the quantity of the powder paint fed is also increased. Thus, the feed rate of the powder paint is varied depending upon the powder level. Because of the reason mentioned above, the variation of the quantity of a discharged powder paint, which is caused by the variation of the powder level, reaches, for example, ±10-odd %.

Further, the apparatus has a drawback that the quantity of feed of a powder paint and the quantity of air conveyed by the ejector cannot be optionally, separately and independently set because the ejector takes out the powder paint mixed with the air fluidized in the fluidizing tank.

Whereas, Japanese Unexamined Patent Publication No. 8-47656 discloses an apparatus for feeding a powder paint into a coating gun in a constant quantity to prevent the variation of the quantity of feed of the powder paint caused by the variation of the powder level of it. The apparatus is arranged such that the powder paint intermittently fed from a fluidizing tank is stored once in a sub-tank, fluidized air is released from the sub-tank using a vibrator or the like, and the powder paint is fed into a coating gun by a screw feeder disposed at a lower portion of the sub-tank. In the constant quantity feeding apparatus disclosed in the publication, a constant quantity feeding property is improved by adjusting the quantity of a discharged powder paint by the rotation of a screw.

However, the constant quantity feeding apparatus disclosed in the publication has a drawback that since the apparatus is made large in size and complicated in construction by the provision of the sub-tank and the vibrator, the cost of the apparatus is increased as compared with the cost of the above ejector type powder paint feeder as well as a long time is necessary to disassemble and wash the apparatus, although the apparatus can reduce the variation of the quantity of a discharged power paint which is caused by a powder level to about ±2% by the installation of the sub-tank.

Further, there is also proposed a constant quantity powder paint feeder the arrangement of which is simplified by omitting a sub-tank or a hopper unit and directly disposing a screw feeder to a fluidizing tank to improve a disassembling property and a washing property and to reduce a cost.

However, the constant quantity powder paint feeder has a problem that since the feeder is not provided with a sub-tank, fluidized air cannot be sufficiently released, a powder volume density is varied by being affected by a powder level, and a sufficiently high constant quantity feeding property cannot be obtained; that is, a quantity of feed is varied about ±7% based on the quantity of a discharged powder paint by the variation of the powder level. Further, the feeder also has a drawback that when a highly fluid powder paint is used, countermeasures against a flushing phenomenon must be taken by employing a mechanical method such as the installation of a straightening vane, or the like.

SUMMARY OF THE INVENTION

An object of the present invention made in view of the above circumstances is to provide a powder paint feeder for powder coating which is installed to a fluidized bed type powder paint tank, which is less expensive and is arranged such that it can feed a powder paint with an excellent constant quantity feeding property without being affected by the powder level in a tank and can be washed easily and efficiently.

To achieve the above-described object, the present invention provides a powder paint feeder for powder coating directly installed to a powder paint tank of a fluidized bed type, comprising: a cylindrical screw casing inserted into the powder paint tank and fixed thereto and having an introducing port into which the powder paint fluidized in the powder paint tank is introduced and a discharging port through which the powder paint dispersed externally of the powder paint tank is discharged; a screw accommodated in the screw casing for feeding the powder paint introduced from the introducing port to the discharging port while compacting it; a deaerating means disposed to the screw casing for deaerating the fluidized powder paint to accelerate the compaction of the powder paint; a dispersing blade mounted on the rotational shaft of the screw in the vicinity of the discharging port downstream of the screw for dispersing the compacted powder paint; and a driving means for rotating the rotational shaft of the screw.

It is preferable that the screw has screw pitches which are narrowed downstream in the feed direction of the powder paint.

Preferably, the screw pitches in at least part of the screw are continuously narrowed downstream in the feed direction of the powder paint or the screw pitches are narrowed stepwise (in a single step or multiple steps) downstream in the feed direction of the powder paint.

Preferably, a ratio of the minimum pitch to the maximum pitch of the screw is ⅔.

Preferably, the deaerating means is disposed at a portion where the screw pitches are going to be narrowed or have been narrowed downstream in the feed direction of the powder paint.

It is also preferable that the driving means is disposed oppositely of the screw with respect to the discharging port, and the powder paint feeder further comprises a purging air discharging means which is disposed in the vicinity of the driving means for preventing the penetration of the powder paint to the driving means.

It is further preferable that the deaerating means is disposed downstream of the screw and upstream of the dispersing blade in the vicinity of the dispersing blade.

It is still further preferable that the deaerating means is a deaerating device which includes a vacuum pump for sucking and removing fluidized air contained in the powder paint by the sucking pressure, and a duct for transmitting sucking pressure and passing the sucked air, and a filter for sucking only the fluidized air in the powder paint without sucking the powder paint.

Preferably, the sucking pressure of the vacuum pump ranges from −100 mmHg to −10 mmHg on the basis of atmospheric pressure.

It is also further preferable that the dispersing blade has a blade piece group disposed in a single stage or blade piece groups disposed in multiple stages spaced apart from each other in the direction of the rotational shaft.

Preferably, the blade piece groups have the same number of blade pieces and each blade piece group is dislocated one another in the rotational direction of the screw.

The another aspect of the present invention provides a powder paint feeder for powder coating directly installed to a powder paint tank of a fluidized bed type, comprising: a cylindrical screw casing inserted into the powder paint tank and fixed thereto and having an introducing port into which the powder paint fluidized in the powder paint tank is introduced and a discharging port through which the powder paint dispersed externally of the powder paint tank is discharged; a screw accommodated in the screw casing for feeding the powder paint introduced from the introducing port to the discharging port while compacting it, the screw having screw pitches which are (continuously or stepwise) narrowed downstream in the feed direction of the powder paint; a dispersing blade mounted on the rotational shaft of the screw in the vicinity of the discharging port downstream of the screw for dispersing the compacted powder paint; and a driving means for rotating the rotational shaft of the screw.

DETAILED DESCRIPTION OF THE INVENTION

A powder paint feeder for powder coating (hereinafter, referred to as a powder feeder) of the present invention will be described with reference to the preferred embodiment shown in FIG. 1.

Figure 1:
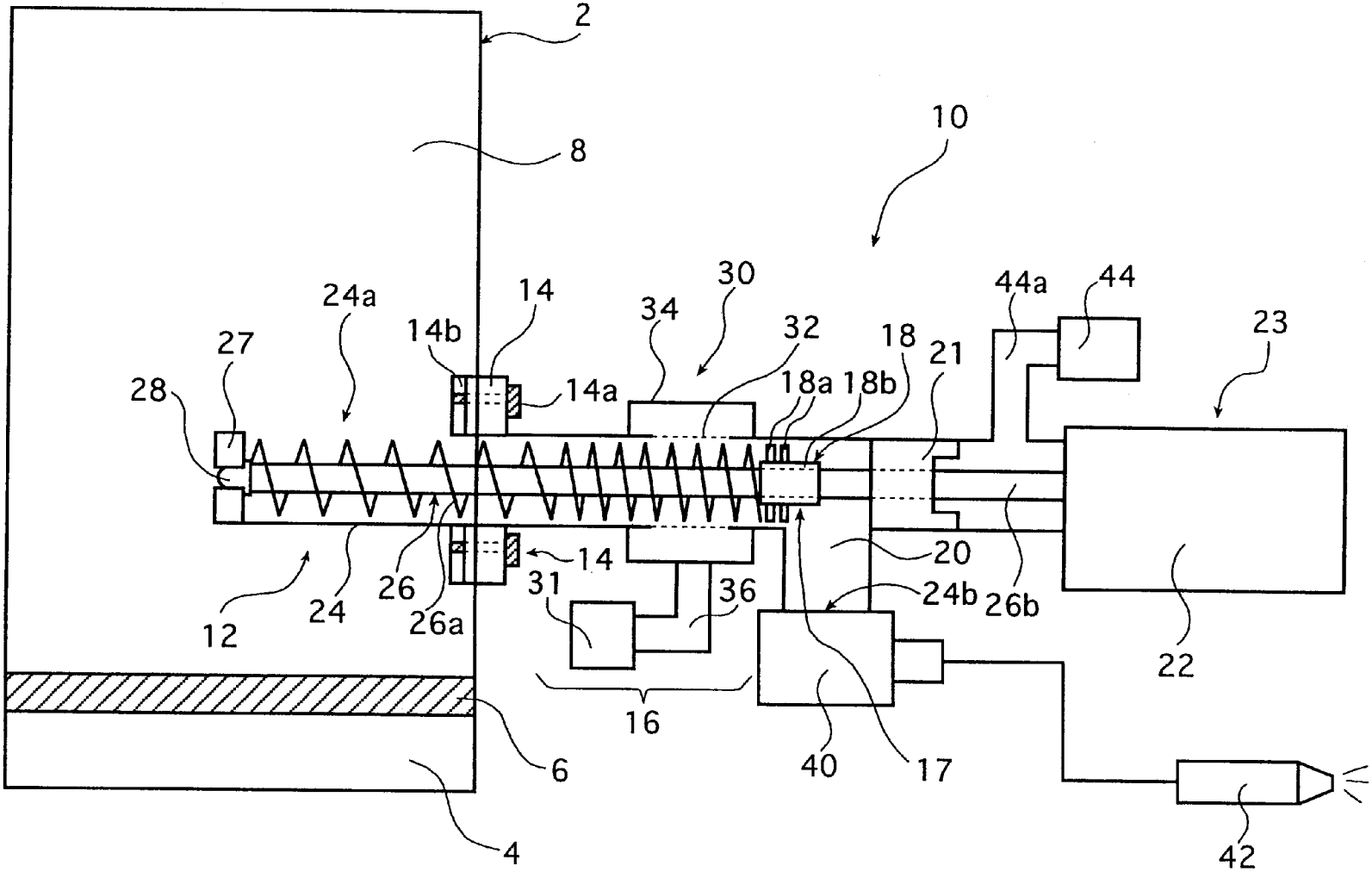
FIG. 1 is a schematic view showing an embodiment of a powder paint feeder for powder coating of the present invention.

FIG. 1 is a schematic view showing an embodiment in which the powder feeder of the present invention is applied to a powder paint tank of a fluidized bed type.

The powder feeder 10 shown in FIG. 1 is directly installed to the fluidized bed 8 of a fluidized bed type powder paint tank (hereinafter, referred to as tank) 2 and feeds the fluidized powder paint (hereinafter, referred to as powder) in the tank 2 to a gun 42 through an ejector 40 in a constant quantity. As shown in FIG. 1, the tank 2 of the illustrated example is composed of an air chamber 4, a porous plate 6 and a fluidized bed 8, and fluidizes a charged powder by supplying pressurized air thereto through the porous plate 6. However, the powder feeder of the present invention is not limited to the illustrated example and it is applicable to various kinds of known fluidized bed type powder paint tanks.

The powder feeder 10 shown in FIG. 1 includes a screw casing 24 and a screw 26 which constitute a screw feeder, a deaerating means 30, a dispersing blade 18 and a driving means 22. The powder feeder 10 is broadly classified into at least an introducing section 12, a fixing section 14, a deaerating/compacting section 16, a dispersing section 17, a discharging section 20 and a driving section 23 on the basis of the functions thereof.

The screw casing 24 forms a flow passage from the introducing section 12 where the powder is introduced into the powder feeder 10 to the ejector 40 through the deaerating/compacting section 16 and the discharging section 20. In addition, the screw casing 24 is a cylindrical body for accommodating the screw 26 extending from the driving means 22. Only the discharging section 20 is formed by being branched downward from the flow passage.

The introducing section 12 is inserted into the fluidized bed 8 of the tank 2 and introduces the powder fluidized in the fluidized bed 8 of the tank 2 into the powder feeder 10. At the introducing section 12, the screw casing 24 is formed to a semi-cylindrical shape having an open upper half portion (180°). The screw casing 24 has a powder introducing port 24*a* formed thereto through which the powder is introduced into the screw casing 24. The end of the screw casing 24 on the introducing section 12 side thereof is closed by a side end member 27 and a bearing 28 is disposed at the center of the side end member 27.

The fixing section 14 is formed to fix the powder feeder 10 to a side of the fluidized bed 8 of the tank 2. At the fixing section 14, the screw casing 24 has a circular-plate-shaped flange. The flange vertically projects to the outside from the boundary between the introducing section 12 and the deaerating/compacting section 16 and has a plurality of holes formed thereto to permit bolts to be inserted therethrough. Thus, the powder feeder 10 can be simply fixed to the tank 2 through the flange using the bolts and nuts. A method of fixing the fixing section 14 to the fluidized bed 8 is not limited to the method of using the bolts and the nuts. That is, the method is not particularly limited and various kinds of conventionally known methods such as welding and so on may be employed.

At the deaerating/compacting section 16, the screw casing 24 is formed to a cylindrical shape from the introducing section 12 in communication therewith. The screw 26 to be described later is disposed in the screw casing 24 and the deaerating means 30 is disposed around the outer periphery of it.

At the discharging section 20, the screw casing 24 is branched downward at the portion thereof between the dispersing blade 18 to be described later and the driving means 22 and forms a flow passage through which the powder dispersed by the dispersing blade 18 to be described later is discharged and reaches the ejector 40. That is, a space, through which the powder is discharged, is provided in the vicinity of the dispersing blade 18 in the screw casing 24 on the downstream side in a feed direction and the screw casing 24 located at the space is branched downward and communicated with the space so that a discharging port 24*b* is formed to the lower end of the branched portion.

The screw 26, which is composed of screw blades 26*a* and a screw shaft 26*b*, is accommodated in the screw casing 24 and feeds the powder introduced in the introducing section 12 to the discharging section 20 through the deaerating/compacting section 16. At the same time, the screw 26 increases the density of the introduced powder (compacts the powder) by applying a pressure thereto in the deaerating/compacting section 16. The screw blades 26*a* are spirally formed around the screw shaft 26*b* from a position near to the extreme end of the screw shaft 26*b* on the fixing section 14 side thereof to a position upstream of the dispersing blade 18 in the feed direction thereof. The other end of the screw shaft 26*b* of the screw 26 is coupled with the driving means 22 and the extreme end thereof is rotatably supported through a bearing 28.

The illustrated screw 26 has a characteristic that the pitches of the screw blades 26*a* are formed widely in the introducing section 12 and formed narrowly in the deaerating/compacting section 16, in addition to the above arrangement. Since the pitches formed narrowly downstream in the feed direction increase the number of windings of the screw blades 26*a* and decrease the volume of the powder which can pass through the respective spaces between the screw blades 26*a*, a pressure is applied to the powder being fed by the screw. The density of the powder is increased (the powder is compacted) by the pressure so that the volume density of the powder can be made constant. With this arrangement, the quantity of feed of the powder can be prevented from being affected by the powder level of the powder in the fluidized bed 8 of the tank 2. Specifically, it is sufficient that the pitches of the screw 26 are made constant at least in the introducing section 12 of the screw 26 and the pitches of the screw 26 in the deaerating/compacting section 16 are stepwise or continuously narrowed downstream in the feed direction. When the pitches are narrowed stepwise, they may be narrowed in one step as shown in the illustrated example or may be narrowed in many steps of two or more steps. Although it is preferable that the ratio of the minimum pitch to the maximum pitch in a single screw is about ⅔, this is not particularly limited.

It should be noted that the screw applied to the present invention is not limited to the screw described above the pitches of which are continuously and stepwise narrowed downstream in the feed direction as long as the powder paint feeder comprises the deaerating means. For example, the screw having uniform screw pitches may be used. However, the screw having the narrowed pitches is more preferable than the screw having the uniform pitches because of the effective compaction of the powder.

The deaerating means 30 more sufficiently compacts the powder in the spaces between the screw blades 26*a* by increasing the density of the powder by sucking and removing the fluidized air contained in the powder in the deaerating/compacting section 16 to thereby more improve the constant quantity feeding property when the powder is fed. At the same time, the deaerating means 30 improves the responsiveness when the feed of a powder is started or stopped, even if the powder has a high flushing property. The deaerating means 30 is composed of a filter 32, a duct 34, a suction pipe 36 and a vacuum pump 31. It is preferable to perform deaeration in the deaerating/compacting section 16.

The filter 32 is continuously disposed around the screw casing 24 in a cylindrical shape by partly or entirely replacing the screw casing 24 located at least downstream of the deaerating/compacting section 16 with the filter 32. The filter 32 is not particularly limited so long as it has fine holes which can suck only the air in the powder without sucking the powder. Specifically, a stainless filter having fine holes of 5 $\mu$m is preferably used.

The duct 34 is a member for covering the outer periphery of the cylindrical filter 32 at prescribed intervals defined therebetween and communicating with the suction pipe 36. When a sucking pressure is transmitted to the filter 32 and a space through which sucked air passes is provided, the vacuum pump 31 can suck air through the filter 32 and the suction pipe 36

The suction pipe 36 couples the duct 34 with the vacuum pump 31, whereby the suction pressure of the vacuum pump 31 is transmitted into the screw casing 24 through the duct 34 and the filter 32.

The vacuum pump 31 deaerates the powder compacted through the suction pipe 36 and the filter 32. The vacuum pump 31 is not particularly limited so long as it can perform pressure reduction of about −100 to −10 mm Hg on the basis of atmospheric pressure, and various types of conventionally known suction means such an ejector and the like can be used. Excessive pressure reduction is not preferable because the powder is excessively compacted and the screw is stopped thereby and the discharge of the powder is made difficult.

The powder being fed by the screw in the screw casing 24 in the fluidized state is compacted while being deaerated by the provision of the narrow pitch screw 26 and the deaerating means 30 with the deaerating/compacting section 16 as described above. Therefore, the powder is charged into the portions between the screw blades 26*a* of the screw 26 in high density and the volume density of the powder is made constant regardless of the powder level in the tank 2. As a result, the powder can be fed in a constant quantity with the quantity of feed of the powder per one revolution of the screw 26 set constant.

It should be noted that the deaerating means 30 may not be necessarily disposed in accordance with the powder, in case that the powder is fully compacted by only the screw 26 having the screw pitches narrowed downstream in the feed direction and thereby the powder can be fed in a constant quantity.

The dispersing blade 18 uniformly disperses the powder compacted through the deaerating/compacting section 16 and made to the constant quantity and discharges the powder into the discharge section 20. This operation is performed to improve the constant quantity feeding property of the powder and to sufficiently electrify the particles of the powder one by one.

Figure 2:
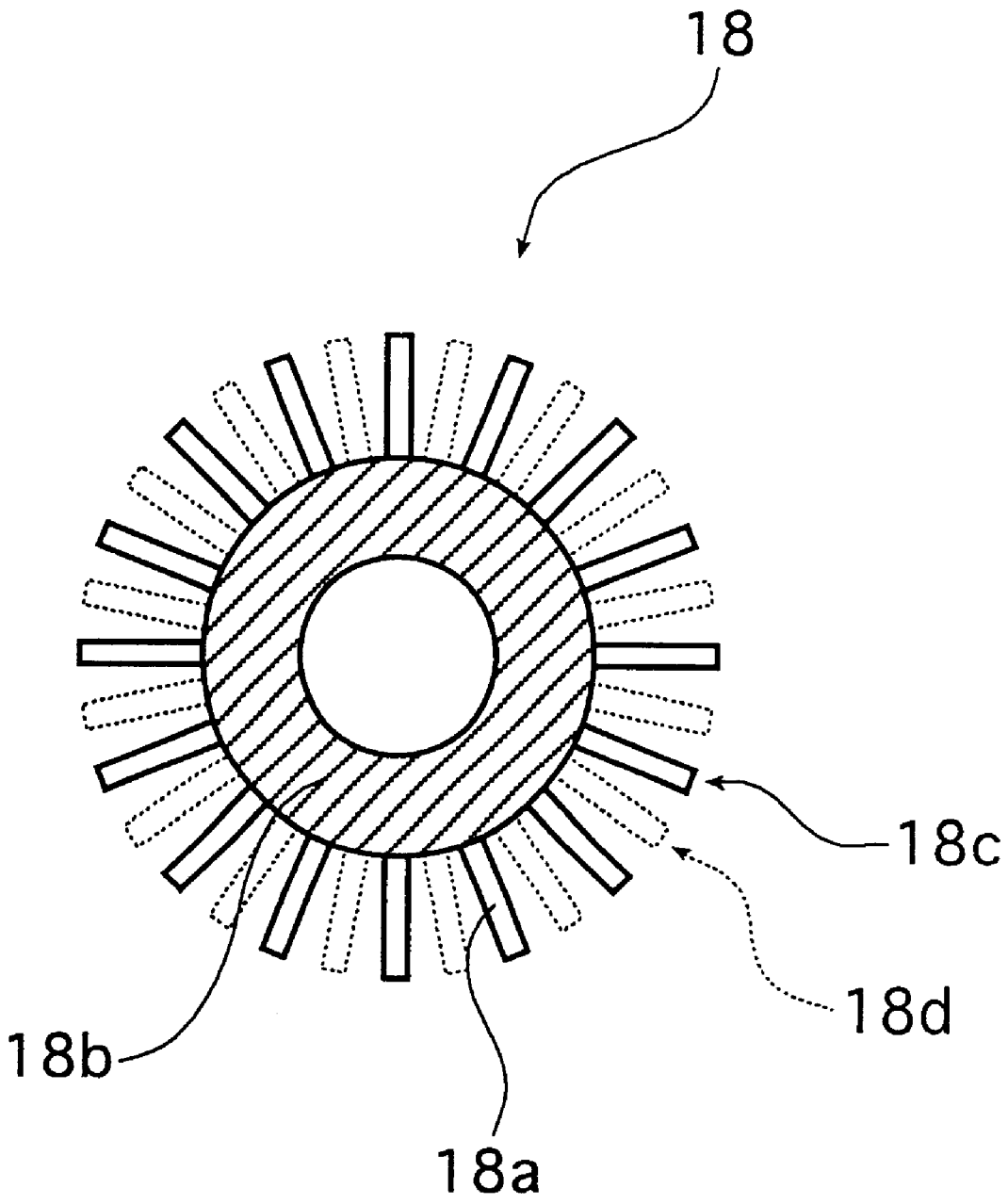
FIG. 2 is a partly enlarged view showing a dispersing blade in the powder paint feeder shown in FIG. 1.

FIG. 2 shows a schematic view of the dispersing blade 18 of the powder feeder 10. The dispersing blade 18 of the illustrated example is composed of a cylindrical dispersing blade main body 18*b*, which permits the screw shaft 26*b* to be inserted therethrough at the center of it and to be fixed thereto, and blade piece groups 18*c* and 18*d* each composed of 16 round-rod-shaped blade pieces 18*a*. The blade pieces 18*a* uniformly and radially project from prescribed positions of the dispersing blade main body 18*b* in the axial direction thereof. The dispersing blade 18 is disposed in the vicinity of the end of the deaerating/compacting section 16 on the downstream side thereof in the feed direction, that is, in the vicinity of the end of the screw blades 26*a* of the screw 26. The blade piece groups 18*c* and 18*d* are dislocated 11.25° in the rotational direction of the screw 26, are disposed in the direction of the center axis of the dispersing blade main body 18*b* in two steps, and are spaced apart from one another at prescribed intervals. The shape of the blade pieces 18*a* is not limited to the round rod shape and may be formed to a plate shape. In addition, the blade pieces 18*a* may be inclined with respect to the screw shaft 26*b*. The blade piece groups may be disposed in one stage or in two or more stages. When they are disposed in the two or more stages, it is preferable that the respective dispersing blades are dislocated by a prescribed angle. However, the angle is not particularly limited. Further, the blade pieces 18*a* may be directly formed to the screw shaft 26*b* without interposing the dispersing blade main body 18*b* therebetween.

The driving means 22 rotates the screw shaft 26*b* and accordingly the screw 26. The driving means 22 is not particularly limited and any conventionally known driving means such as a motor and the like may be used. When the motor or the like is used as the driving means 22, the motor or the like is coupled with the screw shaft 26*b* of the screw 26 by a not shown coupling.

It is preferable that a bearing 21 is interposed between the driving means 22 and the discharging section 20 to rotatably support the screw shaft 26*b*. Further, it is preferable that the bearing 21 closes the driving means 22 from the discharging section 20 as shown in the illustrated example, because the penetration of the powder to the driving means 22 can be prevented thereby.

In addition, it is preferable to interpose a purging air discharging means 44 between the bearing 21 and the driving means 22 to prevent the penetration of the powder to the driving means 22 through the gap of the bearing 21 when the powder is discharged into the discharging section 20. The purging air discharging means 44 is coupled through a coupling pipe 44*a* which is disposed to the screw casing 24 at the position thereof adjacent to the driving means 22 and discharges purging air from the position into the screw casing 24. With this operation, the pressure in the portion between the bearing 21 and the driving means 22 is made higher than the pressure in the discharging section 20 so that the penetration of the powder to the driving means 22 can be prevented. Any conventionally known purging air discharging means such as a compressor for compressing air and the like may be sufficiently used as the purging air discharging means 44 so long as it can discharge a very slight quantity of purging air.

The ejector 40 is connected to the discharging port 24*b* of the screw casing 24 and feeds the powder to the gun 42 so that it is discharged therefrom. The ejector 40 is not particularly limited and any known ejector may be used. For the above purpose, the gun 42 is connected to the ejector 40.

When the powder paint feeder of the present invention arranged as described above is installed to the tank 2, first, a hole, through which the introducing section 12 of the powder paint feeder is inserted, and fixing holes, through which the bolts 14*a* for fixing the fixing section 14 are inserted, are previously formed to the side of the fluidized bed 8 of the tank 2. Next, the introducing section 12 of the powder paint feeder is inserted into the hole to cause the fixing section 14 to come into contact with the side of the tank 2. In this state, the powder feeder 10 is fixed to the side of the tank 2 by inserting the bolts 14*a* through the fixing holes of the fixing section 14 and tightening the bolts 14*a* with the nuts 14*b* through packings.

The powder paint feeder for powder coating of the present invention is essentially arranged as described above. Next, the operation of the powder paint feeder will be described below.

First, a powder is charged into the tank 2 and is fluidized by the air supplied from the air chamber 4 through the porous plate 6. With this operation, the powder flows into the introducing port 24*a* of the introducing section 12 of the screw casing 24.

When the screw 26 is rotated by driving the driving means 22, the powder starts to be fed by the screw 26 rightward in the figure from the introducing section 12, whereby the powder is taken out from the tank 2 and fed up to the deaerating/compacting section 16.

Since the pitches of the screw 26 are made narrower in the deaerating/compacting section 16 than in the introducing section 12, the powder is compacted by the pressure which is applied thereto by the screw blades 26*a* of the screw 26 disposed at the narrower intervals. Further, since the powder is deaerated by the suction means at the same time, it can be still more compacted by the removal of the fluidized air. The volume density of the powder is made constant and a constant quantity of the powder is charged with respect to the pitches of the screw 26 at all times, because the powder is sufficiently compacted while being deaerated. Accordingly, the powder is discharged from the discharge port 24*b* in the quantity which is proportional to the number of revolution (rpm: revolution per minute) of the screw without being almost affected by the powder level in the fluidized bed 8 of the tank 2, whereby the constant quantity feeding property of the powder paint feeder can be improved. Specifically, even if the powder level is varied, the variation of the feed rate of the powder can be reduced within about ±1%.

The powder having passed through the deaerating/compacting section 16 reaches the dispersing blade 18. The powder which has been compacted and whose quantity has been made constant is uniformly dispersed by the dispersing blade 18 and is discharged into the discharging section 20 in a constant quantity. The powder having been discharged into the discharging section 20 is fed to the gun 42 in the constant quantity by being sucked by the ejector 40 and fed thereby under pressure. Powder coating is carried out by the powder discharged from the gun 42.

It should be noted that the distance between the filter 32 and the screw 26 is preferably set at a smaller value, if contact of the screw blades 26*a* of the screw 26 with the filter 32 does not cause damage or breakage of the screw blades 26*a* and the filter 32. An appropriate value can be selected depending on the powder to be fed and the shape and size of the screw 26, the type and size of the filter 32, and the size precision and assembly precision thereof.

Experiment 1

The inventors performed powder paint feeding experiments as to the characteristics shown below using the powder feeder 10 described above and shown in FIG. 1. Not only an experiment using the variable pitch screw 26 of which the pitches are narrowed stepwise toward the downstream side, but also an experiment in which the variable pitch screw 26 was replaced with the uniform pitch screw (not shown) were performed.

The type of a powder paint, the arrangements and the sizes of the main components of the powder feeder 10 used in the experiment and the operating conditions of the feeder 10 are as shown below.

| | |
|---|---|
| Powder paint | |
| Type | Acryl |
| Average particle size | 30 μm |
| powder feeder | |
| Introducing port shape | opened 180° (upper half) |
| Introducing port length | 80 mm |
| Screw outside diameter | 27 mm |
| Screw shaft diameter | 8 mm |
| Screw pitches | |
| Variable pitch screw | |
| Introducing section | 15 mm |
| Deaerating/compacting section | 10 mm |
| Uniform pitch screw | 13 mm |
| Filter material | stainless |
| Filter fine hole diameter | 5 μm |
| Degree of pressure reduction of filter section −40 mmHg (on the basis of atmospheric pressure) | |
| Pressure reducing method | Vacuum pump |

(Controllability of quantity of feed)

Figure 3:
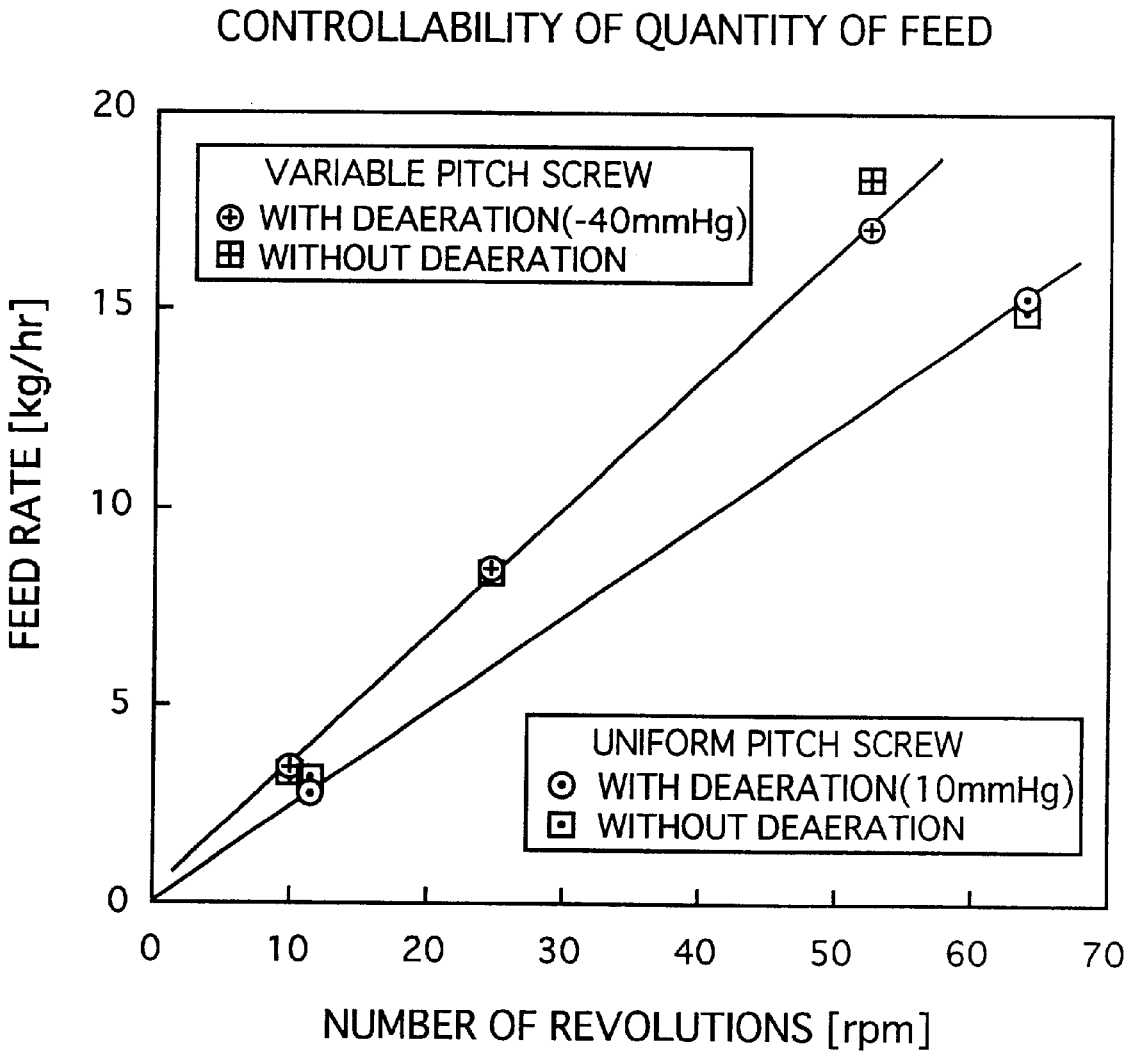
FIG. 3 is a graph showing the relationship between the number of revolution (revolution per minute) of a screw and the feed rate of a powder in the powder paint feeder shown in FIG. 1.

To examine whether the feed rate of the powder was proportional to each of the numbers of revolution (rpm) of the variable pitch screw 26 and the uniform pitch screw, the relationship between the numbers of revolution (rpm) and the feed rate was examined. First, the feed rates at respective numbers of revolution (rpm) of the screws were measured by changing the number of revolution (rpm) while performing deaeration (−40 mmHg in the variable pitch screw and −10 mmHg in the uniform pitch screw on the basis of atmospheric pressure). Further, the relationship between the numbers of revolution (rpm) of the screws and the feed rate was examined in the same manner except that no aeration was performed. FIG. 3 shows the result of the experiments.

As apparent from FIG. 3, when deaeration was performed in the powder feeder of the present invention using the variable pitch screw, the proportional relationship of the feed rate of the powder to the number of revolution (rpm) of the screw was better than in the case where no deaeration was performed. It has been found that the feed rate of the power was reduced in the case of the uniform pitch screw, as compared with the case of the variable pitch screw, although a preferred proportional relationship was obtained whether the deaeration was performed or not.

(Constant quantity feeding property)

To examine how the quantity of the powder fed from the powder feeder of the present invention was stable with time, the changes with time of the feed rate of the powder were measured under the respective conditions shown in the examples 1–9 of Table 1 (the pitch type of the screw, the number or revolution (rpm) of the screw, the degree of pressure reduction, the powder level) and a coefficient of variation was calculated from the standard deviation of the changes using the following formula. Further, the change of a feed rate was also measured in the same manner in the case where no pressure reduction was performed in the powder feeder using the uniform pitch screw, thereby calculating a coefficient of variation as a comparative example 1. It can be found that a smaller coefficient of variation exhibits a better constant quantity feeding property. Table 1 shows the result of the measurement.

coefficient of variation=(standard deviation)/(average quantity of feed)

The variable pitch screw was used in the examples 1–8, and the uniform pitch screw was used in the example 9 and the comparative example 1. Further, the measurements in the examples 1–3 were performed under the same conditions except that the number of revolution (rpm) of the screw was changed, the measurements in the examples 4 and 8 were performed under the same conditions except that deaeration was carried out in the example 4 and no deaeration was carried out in the example 8, the measurements in the examples 5–7 were performed under the same conditions except that powder levels were changed, and the measurements in the example 9 and the comparative example 1 were performed under the same conditions except that deaeration was carried out in the example 9 and no deaeration was carried out in the comparative example 1.

As apparent from Table 1, it can be found that the powder feeder of the present invention exhibits a low coefficient of variation under any conditions and is stable with time as compared with the case where no deaeration is performed in the powder feeder using the uniform pitch screw. It is also found from the comparison between the examples 4 and 8, and the comparison between the example 9 and the comparative example 1, that the average quantity of feed in the case where deaeration is performed is more than in the case where no deaeration is performed, whether the screw pitches are uniform or variable, but that the coefficient of variation is reduced to be about one-half. It is further found from the comparison between the example 3 using the variable pitch screw and the example 9 using the uniform pitch screw, both examples showing the numbers of revolution close to each other, that the variable pitch screw is more excellent in the constant quantity feeding property than the uniform pitch screw, since the example 3 shows a more increased average quantity of feed and a much more reduced coefficient of variation at a number of revolution a little decreased, although the powder level is different.

(Effect of powder level)

Figure 4:
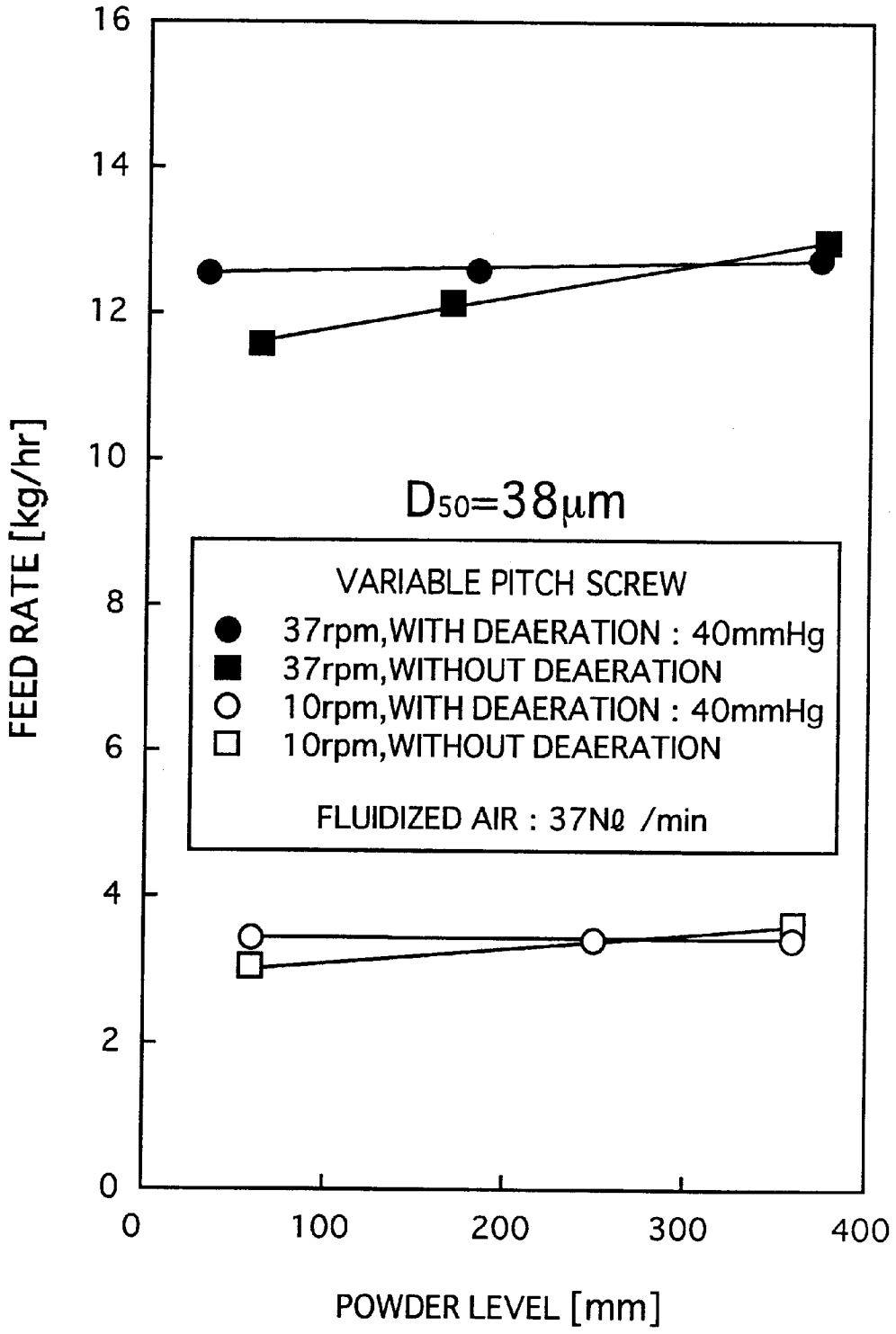
FIG. 4 is a graph showing the relationship between the powder level in a tank and the feed rate in the powder paint feeder shown in FIG. 1.
Figure 5:
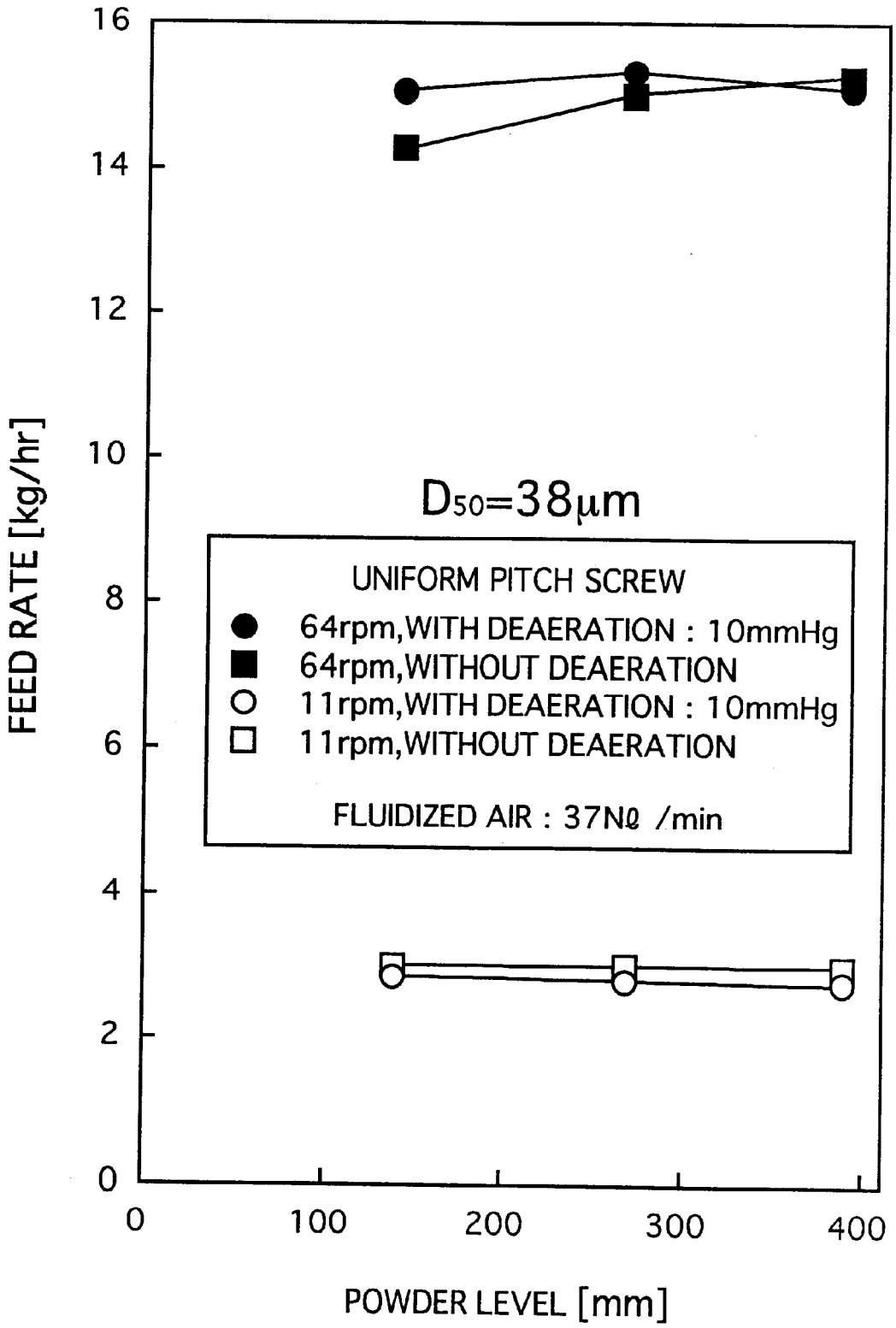
FIG. 5 is a graph showing the relationship between the powder level in a tank and the feed rate in a powder paint feeder provided with a uniform pitch screw.

The changes of the feed rate to the change of the height of a powder surface (powder level) in the tank were measured as to the respective numbers of revolution (rpm) of 37 rpm and 10 rpm in the case of using the variable pitch screw, and of 64 rpm and 11 rpm in the case of using the uniform pitch screw, respectively. The measurement was performed in the same manner except that no deaeration was performed. FIG. 4 shows the result of the measurements when using the variable pitch screw. FIG. 5 shows the result of the measurements when using the uniform pitch screw.

As can be seen from FIG. 4, when deaeration is performed in the powder feeder with the variable pitch screw according to the present invention, a more constant feed rate can be maintained at any numbers of revolution (rpm) of the screw irrespective of the change of the powder level, as compared with the case where no deaeration was performed.

As apparent from FIG. 5, when deaeration is performed in the powder feeder with the uniform pitch screw according to the invention, a more constant feed rate can be maintained at any numbers of revolution (rpm) of the screw irrespective of the change of the powder level than the conventional case where no deaeration is performed. FIG. 5 shows in particular that a powder paint can be fed constantly in the case of low powder level/high feed rate where the feed amount is apt to vary.

The powder feeder of the present invention is provided with at least one of the variable pitch screw and the deaerating means. As is clear from the above, this powder feeder is more excellent in the feed rate (feed amount), the constant quantity feeding property and the feed constancy with respect to the powder level than conventional powder feeders with uniform pitch screw that have no deaerating means. It is found in particular that constant feed is achieved even in the case of low powder level/high feed rate where the feed amount. is apt to vary. It is also found that the powder feeder of the invention which has both of the variable pitch screw and the deaerating means is significantly excellent in the feed rate, the controllability of quantity of feed, the constant quantity feeding property, and the feed constancy with respect to the powder level.

pressure reduction to achieve the coefficient of variation could be significantly reduced to be one-fourth by reducing the clearance between the screw 26 and the filter 32 by a factor of 3.

As described above, since the powder paint feeder for powder coating of the present invention is simply arranged so that it can be directly installed to the fluidized bed of the tank, it is excellent in a dismantling property and a washing property. Moreover, since the powder paint feeder of the present invention excludes the effect of the variation of the

TABLE 1

| | Examples | | | | | | | | | Comparative example |
|---|---|---|---|---|---|---|---|---|---|---|
| | 1 | 2 | 3 | 4 | 5 | 6 | 7 | 8 | 9 | 1 |
| Pitch type of screw | Variable | Variable | Variable | Variable | Variable | Variable | Variable | Variable | Uniform | Uniform |
| Number of revolution of screw (rpm) | 9.9~10.1 | 25.1~25.2 | 53.1 | 9.9~10.1 | 33.0~33.2 | 33.0~33.2 | 33.0~33.2 | 9.9~10.1 | 64.0 | 64.0 |
| Degree of pressure reduction (mmHg) | −40 | −40 | −40 | −40 | −20 | −40 | −60 | 0 | −60 | 0 |
| Powder level (mm) | 160 | 260 | 260 | 260 | 160 | 160 | 160 | 245 | 140 | 140 |
| Average quantity of feed (kg/h) | 3.4 | 8.5 | 17.0 | 3.3 | 11.0 | 11.2 | 11.3 | 3.1 | 15.13 | 14.33 |
| Standard deviation (g/h) | 14.5 | 21.7 | 12.5 | 12.0 | 10.1 | 20.0 | 26.9 | 22.8 | 65.0 | 126.1 |
| Coefficient of variation (%) | 0.42 | 0.26 | 0.07 | 0.36 | 0.09 | 0.18 | 0.24 | 0.71 | 0.43 | 0.88 |

Experiment 2

Powder paint feeding experiments were performed as in Experiment 1 using the powder feeder 10 as shown in FIG. 1 to determine the effect of the clearance between the filter 32 in the deaerating means 30 and the screw blades 26*a* the screw 26 on the suction pressure. The type of the powder paint and the structure and operating conditions of the powder feeder 10 were the same as in Experiment 1 except for the structure and size of the screw 26 and the size of the filter 32. Table 2 shows the structure and size of the screw 26, the size of the filter 32, the clearance between the screw 26 and the filter 32, and other operating conditions and the results obtained.

TABLE 2

| | Example 10 | Example 11 |
|---|---|---|
| Pitch type of screw | Variable | Variable |
| Screw outer diameter (mm) | 28.0 | 26.5 |
| Screw pitch (introducing section) (mm) | 15 | 15 |
| Screw pitch (deaerating/compacting section) (mm) | 10 | 13 |
| Filter inner diameter (mm) | 35.2 | 28.9 |
| Clearance between filter and screw | 3.6 | 1.2 |
| Number of revolution of screw (rpm) | 10 | 10 |
| Degree of pressure reduction (mmHg) | −40 | −10 |
| Powder level (mm) | 160 | 160 |
| Amount of fluidized air (Nl/min) | 35 | 35 |
| Feed amount (average quantity of feed) (kg/h) | 3.4 | 2.5 |
| Coefficient of variation (%) | 0.41 | 0.36 |

As is clear from Table 2, the performance could be attained at a similar level, and especially, the degree of powder level in the tank by deaerating and compacting a fluidized powder paint and instantly and uniformly disperses and feeds the compacted powder paint, the powder paint feeder can disperse and feed the powder paint with a high constant quantity feeding property imparted to the ejector and the gun without being affected by the powder level in the tank.

Since a discharged quantity of the powder paint can be measured externally of a coating booth, the discharged quantity can be easily adjusted.

Further, the provision of the non-mechanical deaerating mechanism permits even a powder having a high flushing property to be fed by the powder paint feeder of the present invention as well as the powder paint feeder is excellent in responsiveness when the feed of the powder is started or stopped.

What is claimed is:

1. A powder paint feeder for powder coating directly installed to a powder paint tank of a fluidized bed type, comprising:

a cylindrical screw casing inserted into the powder paint tank and fixed thereto and having an introducing port into which powder paint fluidized in the powder paint tank is introduced and a discharging port through which the powder paint dispersed externally of the powder paint tank is discharged;

a screw accommodated in said screw casing for feeding the powder paint introduced from the introducing port to the discharging port while compacting the powder paint;

a deaerating means operatively associated with said screw casing for deaerating the fluidized powder paint to accelerate compaction of the powder paint;

a dispersing blade mounted on a rotational shaft of said screw in a vicinity of the discharging port downstream of said screw for dispersing the compacted powder paint; and a driving means for rotating the rotational shaft of said screw.

2. The powder paint feeder according to claim 1, wherein said screw has screw pitches which are narrowed downstream in a feed direction of the powder paint.

3. The powder paint feeder according to claim 2, wherein said screw pitches in at least part of the screw are continuously narrowed downstream in the feed direction of the powder paint.

4. The powder paint feeder according to claim 2, wherein said screw pitches are narrowed stepwise downstream in the feed direction of the powder paint.

5. The powder paint feeder according to claim 2, wherein a ratio of a minimum pitch to a maximum pitch of said screw is ⅔.

6. The powder paint feeder according to claim 2, wherein said deaerating means is disposed at a portion where the screw pitches are going to be narrowed or have been narrowed downstream in the feed direction of the powder paint.

7. The powder paint feeder according to claim 1, wherein said driving means is disposed oppositely of said screw with respect to the discharging port, and the powder paint feeder further comprises a purging air discharging means which is disposed in a vicinity of said driving means for preventing penetration of the powder paint to said driving means.

8. The powder paint feeder according to claim 1, wherein said deaerating means is disposed downstream of said screw and upstream of said dispersing blade in a vicinity of said dispersing blade.

9. The powder paint feeder according to claim 1, wherein said deaerating means is a deaerating device which includes a vacuum pump for sucking and removing fluidized air contained in the powder paint by sucking pressure, and a duct for transmitting sucking pressure and passing sucked air, and a filter for sucking only the fluidized air in the powder paint without sucking the powder paint.

10. The powder paint feeder according to claim 9, wherein said sucking pressure of said vacuum pump ranges from −100 mmHg to −10 mmHg on a basis of atmospheric pressure.

11. The powder paint feeder according to claim 1, wherein said dispersing blade has a blade piece group disposed in a single stage or blade piece groups disposed in multiple stages spaced apart from each other in a direction of the rotational shaft.

12. The powder paint feeder according to claim 11, wherein said blade piece groups have same number of blade pieces and each blade piece group is dislocated one another in a rotational direction of the screw.

13. A powder paint feeder for powder coating directly installed to a powder paint tank of a fluidized bed type, comprising:

a cylindrical screw casing inserted into the powder paint tank and fixed thereto and having an introducing port into which powder paint fluidized in the powder paint tank is introduced and a discharging port through which the powder paint dispersed externally of the powder paint tank is discharged;

a screw accommodated in said screw casing for feeding the powder paint introduced from the introducing port to the discharging port while compacting the powder paint, said screw having screw pitches which are narrowed downstream in a feed direction of the powder paint;

a dispersing blade mounted on a rotational shaft of said screw in a vicinity of the discharging port downstream of said screw for dispersing the compacted powder paint; and a driving means for rotating the rotational shaft of said screw.

* * * * *